United States Patent [19]

Obasogie

[11] Patent Number: 4,881,554

[45] Date of Patent: Nov. 21, 1989

[54] SMOKING HABIT BREAKER

[76] Inventor: Jackson Obasogie, 1251 NE. 108th St., #302, Miami, Fla. 33161

[21] Appl. No.: 121,278

[22] Filed: Nov. 16, 1987

[51] Int. Cl.[4] ..... A24F 19/10

[52] U.S. Cl. ..... 137/270; 131/231; 131/238; 340/328; 340/622

[58] Field of Search ..... 131/238, 231, 270; 340/328, 622

[56] References Cited

U.S. PATENT DOCUMENTS

| | | | |
|---|---|---|---|
| 2,788,085 | 4/1957 | Waller | 131/238 |
| 4,119,419 | 10/1978 | Passaro et al. . | |
| 4,733,675 | 3/1988 | Destro | 131/238 |

*Primary Examiner*—V. Millin

*Attorney, Agent, or Firm*—Jerry T. Kearns

[57] ABSTRACT

An ashtray has a hollow housing in the interior of which is mounted a smoke detector and an audio playback unit for providing an anti-smoking message upon the detection of smoke. A digital counter counts the number of activations of the smoke detector. The ashtray has a concave ash receiving depression on a top surface of the hollow housing. A centrally disposed smoke passage in the concave depression allows smoke to be drawn into the smoke detector through a smoke tunnel by a small fan. The device is battery powered and is provided with an on/off switch for selectively disconnecting the battery power supply.

7 Claims, 2 Drawing Sheets

Fig 1
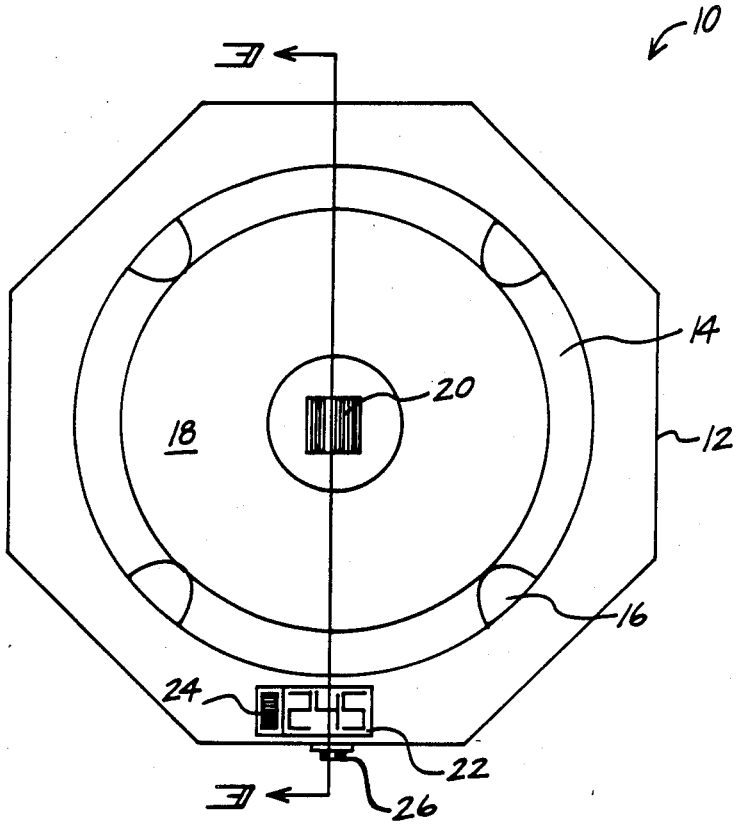
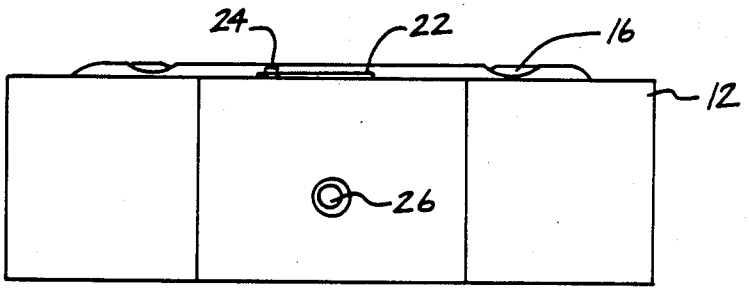
Fig 2

FIG 3
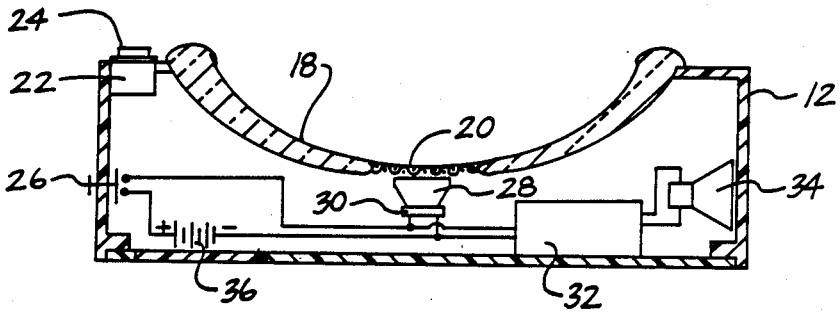
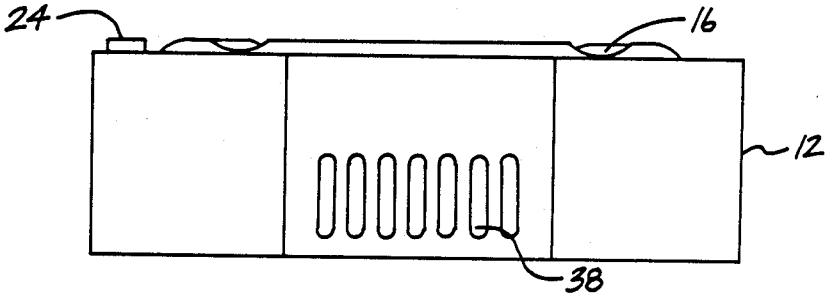
FIG 4

SMOKING HABIT BREAKER

BACKGROUND OF THE INVENTION

1. Field of the Invention

The present invention relates to smoking habit breakers, and more particularly pertains to an ashtray provided with a smoke detector and an audio playback device for broadcasting an anti-smoking message upon activation of the smoke detector. Various types of programs are utilized to assist smokers in breaking the smoking habit. The present invention provides a person who is attempting to quit smoking with an added psychological incentive to do so. Each time a smoker flicks an ash or places a lighted cigarette into the ashtray, an anti-smoking message is broadcast. A counter keeps track of the number of activations of the smoke detector. Thus, the smoker is provided with a quantitative measure of their progress in their stop smoking program.

2. Description of the Prior Art

Various types of smoke detectors and ashtrays are known in the prior art. Ashtrays are available with filters and fans to prevent a cigarette smoker from fouling the air in a room. Additionally, various types of audio message playback devices are commercially available. These available devices include tape recorder audio devices of the type utilized in phone answering machines, and electronic digital voice message units of the type utilized to provide warning messages in automobiles and computer games. While these various components of the present invention are commercially available, applicant is not aware of any prior art ashtrays which utilize a smoke detector in combination with an audio message unit to provide an anti-smoking message upon the detection of smoke.

Conventional smoking habit breaking programs include the use of nicotine gums, psychological training programs and smoking substitutes. Inasmuch as the art is relatively crowded with respect to these various types of smoking habit breakers, it can be appreciated that there is a continuing need for and interest in improvements to such smoking habit breakers, and in this respect, the present invention addresses this need and interest.

SUMMARY OF THE INVENTION

In view of the foregoing disadvantages inherent in the known types of smoking habit breakers now present in the prior art, the present invention provides an improved smoking habit breaker. As such, the general purpose of the present invention, which will be described subsequently in greater detail, is to provide a new and improved smoking habit breaker which has all the advantages of the prior art smoking habit breakers and none of the disadvantages.

To attain this, a representative embodiment of the concepts of the present invention is illustrated in the drawings and makes use of a hollow housing having a concave ash receiving tray formed on a top surface thereof. A smoke passage is centrally disposed in the ash receiving tray and is in communication with the hollow interior of the housing. A smoke tunnel is mounted in the interior housing in registry with the smoke passage. A fan in the smoke tunnel draws smoke into the interior of the housing adjacent a smoke detection device. Upon activation of the smoke detector, an audio message unit is actuated to broadcast an anti-smoking message. A digital counter is concurrently incremented to maintain an accurate record of the number of actuations of the smoke detector. The device is battery operated and is provided with a switch for selectively disconnecting the battery power supply.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set foth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved smoking habit breaker which has all the advantages of the prior art smoking habit breakers and none of the disadvantages.

It is another object of the present invention to provide a new and improved smoking habit breaker which may be easily and efficiently manufactured and marketed.

It is a further object of the present invention to provide a new and improved smoking habit breaker which is of a durable and reliable construction.

An even further object of the present invention is to provide a new and improved smoking habit breaker which is susceptible of a low cost of manufacture with regard to both materials and labor, and which accordingly is then susceptible of low prices of sale to the consuming public, thereby making such smoking habit breakers economically available to the buying public.

Still yet another object of the present invention is to provide a new and improved smoking habit breaker which provides in the apparatuses and methods of the prior art some of the advantages thereof, while simultaneously overcoming some of the disadvantages normally associated therewith.

Still another object of the present invention is to provide a new and improved smoking habit breaker which utilizes an ashtray provided with a smoke detector and an audio message unit for broadcasting an anti-smoking message upon activation of the smoke detector.

Yet another object of the present invention is to provide a new and improved smoking habit breaker which utilizes an ashtray having a hollow interior provided with a smoke detector, an audio message unit for broadcasting an anti-smoking message, and a dgital counter for maintaining an accurate record of the number of activations of the smoke detector.

Even still another object of the present invention is to provide a new and improved smoking habit breaker which utilizes an ashtray having a hollow interior with a smoke tunnel and a fan for drawing smoke to a smoke detector.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a top plan view of the smoking habit breaker ashtray of the present invention.

FIG. 2 is a side view of the smoking habit breaker ashtray of the present invention.

FIG. 3 is a cross sectional view taken along line 3—3 of FIG. 1, illustrating the internal mechanisms of the smoking habit breaker ashtray of the present invention.

FIG. 4 is a side view, illustrating the speaker mounting of the smoking habit breaker ashtray of the present invention.

DESCRIPTION OF THE PREFERRED EMBODIMENT

With reference now to the drawings, and in particular to FIG. 1 thereof, a new and improved smoking habit breaker embodying the principles and concepts of the present invention and generally designated by the reference numeral 10 will be described.

More specifically, it will be noted that the first embodiment 10 of the invention includes a hollow octagon shaped housing 12. An arcuate ridge 14 is provided with a plurality of circumferentially spaced cigarette holding notches 16. The ridge 14 is formed contiguously with a concave ash receiving tray 18. The concave tray 18 slopes downwardly to a central smoke passage 20. The smoke passage 20 communicates with the interior of the housing 12. A screen is provided over the smoke passage to prevent ash from falling into the interior of the housing 12. A liquid crystal display type digital counter 22 is mounted on the top surface of the housing 12. A reset button 24 is provided for resetting the counter 22 to zero. An on/off switch 26 is mounted through a side wall of the housing 12.

With reference now to FIG. 2, it may be seen that the switch 26 is centrally mounted on one of the eight side walls of the housing 12. The reset button 24 for the counter 22 extends slightly above the top surface of the housing 12. The cigarette receiving notches 16 allow lighted cigarettes to be rested on the ridge 14, in the normal fashion.

In the cross sectional view of FIG. 3, it may be seen that the concave ash receiving tray 18 slopes downwardly to a centrally disposed smoke passage 20. The smoke passage 20 is covered by a conventional screen material. A tapered smoke tunnel 28 has a large end in registry with the smoke passage 20. A small fan in the interior of the smoke tunnel 28 draws smoke through the passage 20 and into contact with a smoke detection device 30. This smoke detection device 30 may be of a conventional type such as a photo electric or an ion type smoke detector. The smoke detector 30 is connected for actuation of an audio message playback unit 32. This audio message playback unit 32 may be in the form of an audio tape unit of the type utilized in phone answering machines, or may be an electronic digital voice unit of the type utilized in automobile message systems or computer games. The audio message playback unit 32 broadcasts an anti-smoking message through a speaker 34. An example anti-smoking message is "Cigarette smoking causes cancer. For the sake of your loved ones, please break the habit." A battery 36, which may be of any conventional type, is connected for energizing the previously described components. An on/off switch 26 allows for selective disconnection of the battery 36. A liquid crystal display type digital counter 22 is connected for maintaining an accurate record of the number of activations of the smoke detector 30.

With reference now to FIG. 4, a grill 38 is provided through a side wall of the housing 12 for the speaker 34. The ashtray 10 of the present invention may be formed from plastic, metal, or other conventional materials.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved ashtray for helping smokers to break the smoking habit, comprising;

a hollows housing having an interior;

a concave ash receiving depression formed in a top surface of said housing;

a smoke passage centrally disposed in said depression, said passage communicating with the interior of said housing;

a smoke tunnel in said housing interior in registry with said smoke passage;

a smoke detector in said housing interior;

a fan in said tunnel for drawing smoke to said smoke detector;

auido means for playing a recorded audio anti-smoking verbal message in response to detection of smoke by said smoke detector;

a digital counter operatively connected for counting the number of activations of said smoke detector;

battery means operatively connected for powering said fan, said smoke detector, said audio means and said counter; and a switch for selectively connecting said disconnecting said battery means.

2. A new and improved ashtray for helping smokers to break the smoking habit, comprising:

hollow housing means;

concave ash receiving means on a top surface of said housing means;

smoke passage means in said concave ash receiving means communicating with an interior of said hollow housing means;

smoke detection means in said housing interior;

means for playing a recorded audio anti-smoking verbal message in response to detection of smoke by said smoke detection means; and counter means operatively connected to said smoke detection means for maintaining a record of the number of activations of said smoke detection means.

3. The smoking habit breaker of claim 2, wherein said counter means is of the LCD type and is provided with a reset button.

4. The smoking habit breaker of claim 2, wherein said audio means comprises a playback unit.

5. The smoking habit breaker of claim 2, wherein said audio means comprises a computer generated digital voice unit.

6. The smoking habit breaker of claim 2, further comprising battery means for powering said smoke detection means and said audio means and switch means for selectively disconnecting said battery means.

7. The smoking habit breaker of claim 2, further comprising fan means in the interior of said housing for drawing smoke through said smoke passage means to said smoke detection means.

* * * * *